United States Patent [19]

Rogers

[11] 4,067,571

[45] Jan. 10, 1978

[54] STANCE TRAINING APPARATUS

[75] Inventor: Orley David Rogers, Farwell, Mich.

[73] Assignee: Rogers Athletic Company, Farwell, Mich.

[21] Appl. No.: 617,296

[22] Filed: Sept. 29, 1975

[51] Int. Cl.[2] ..... A63B 67/00

[52] U.S. Cl. ..... 273/55 R

[58] Field of Search ..... 273/55 R, 58 A, 58 C, 273/95 A, 95 AA, 97 R, 25; 9/310 E, 310 F

[56] References Cited

U.S. PATENT DOCUMENTS

| | | | |
|---|---|---|---|
| 3,011,786 | 12/1961 | Schmuck | 273/55 R |
| 3,508,747 | 4/1970 | Orsatti | 273/25 |
| 3,580,574 | 5/1971 | Hornak | 273/55 R |
| 3,731,929 | 5/1973 | Landry | 273/95 A |
| 3,815,905 | 6/1974 | Golomb | 273/25 |

*Primary Examiner*—William H. Grieb
*Assistant Examiner*—T. Brown

[57] ABSTRACT

Apparatus for training a football player to maintain a predetermined wide base stance during football blocking or tackling exercises comprising a stance training member disposable on the ground between the legs of a football player, and a resilient cord for connecting the stance training member to a football blocking sled to draw the stance training member with the sled when the blocking sled is charged by a football player but permitting the sled to move forwardly relative to the stance training member if a player inadvertently steps on the member when he charges the sled.

12 Claims, 7 Drawing Figures

STANCE TRAINING APPARATUS

BACKGROUND OF THE INVENTION

This invention relates to football training apparatus and more particularly to apparatus for training football players to maintain their legs spread a predetermined distance during blocking or tackling exercises.

A football player who executes a face block or a shoulder block and who maintains a wide stance is generally more stable and thus more difficult to knock down than he would be if he maintained his legs close together. When a lineman assumes his initial stance at the line of scrimmage prior to the start of the play, he generally assumes a stance in which his legs are spread a sufficient distance to effect a proper block. After the start of the play and initial contact with an opposing player, some linemen tend to bring their legs closer together and thus become unstable and more easily knocked down. It is important that a football player maintain a relatively wide stance during the entire blocking movement in order to obtain maximum blocking effectiveness.

Accordingly, it is an object of the present invention to provide football training apparatus which will teach a football player to maintain a relatively wide stance throughout an entire blocking or tackling exercise.

It is another object of the present invention to provide football training apparatus which will teach a football player a more stable stance when he is blocking or tackling an opposing player.

The present invention comprises a stance training member which is disposable between the legs of a football player and is adapted to be connected by a resilient cord to a football blocking sled mounting a chargeable pad, the cord being of such length that the player executing the block will straddle the stance training member when he is in position to engage the blocking pad.

It is important that the cord be resilient so that in the event a player inadvertently steps on the stance training member as the block is being executed, the blocking exercise is not interrupted as it would be if the cord was inelastic. With apparatus constructed according to the present invention, if a player inadvertently steps on the stance training member, forward movement of the stance training member is inadvertently interrupted although the sled and chargeable pad can continue moving forwardly. As soon as the player steps off the stance training member, the stance training member will be moved forwardly toward the sled to maintain its position between the football players legs so that the blocking exercise can continue until fully executed. Accordingly, it is an object of the present invention to provide a stance training member which is connected to a blocking sled via a yieldable member.

Other objects and advantages of the present invention will become apparent to those of ordinary skill in the art as the description thereof proceeds.

SUMMARY OF THE INVENTION

A stance training device for a ground supported football training sled having a chargeable member which is movable forwardly when charged by a football player, a resilient member for connecting the stance training device to the sled for forward movement therewith but permitting the sled to move forwardly relative to the stance training device if a player inadvertently steps on the device as the chargeable member is moving forwardly.

The present invention may more readily be understood by reference to the accompanying drawings in which.

DESCRIPTION OF THE PREFERRED EMBODIMENT

Figure 1:
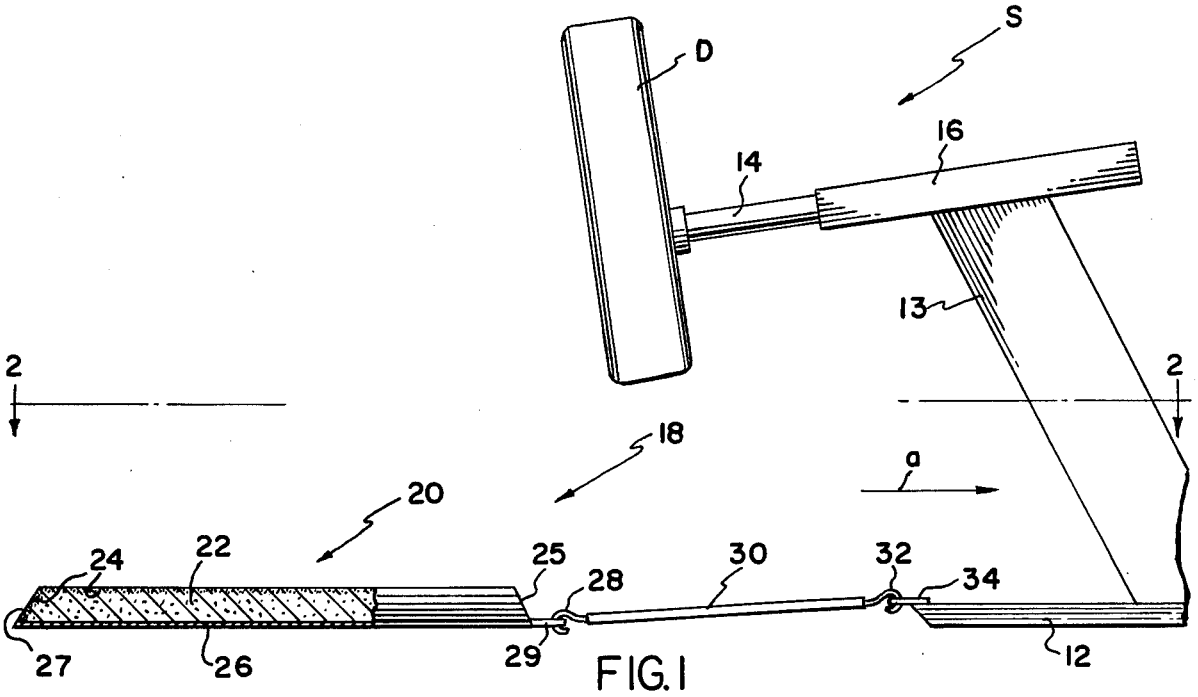
FIG. 1 is a partly sectional, side elevational view of apparatus constructed according to the present invention.
Figure 2:
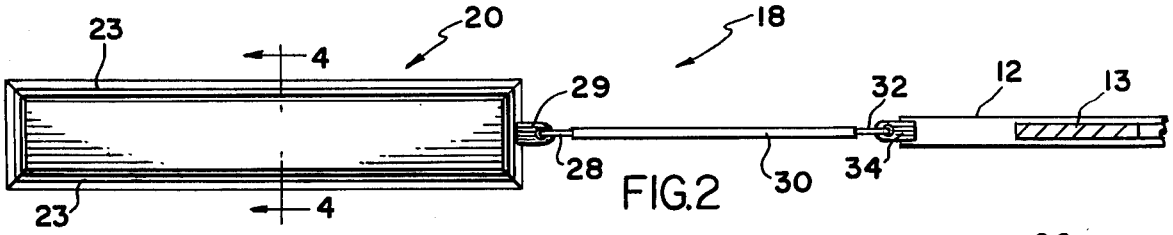
FIG. 2 is a top plan sectional view, taken along the line 2—2 of FIG. 1.
Figure 4:
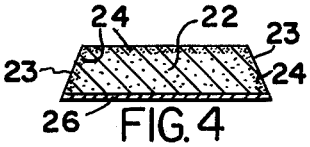
FIG. 4 is an enlarged, sectional end view, taken along the line 4—4 of FIG. 2.
Figure 3:
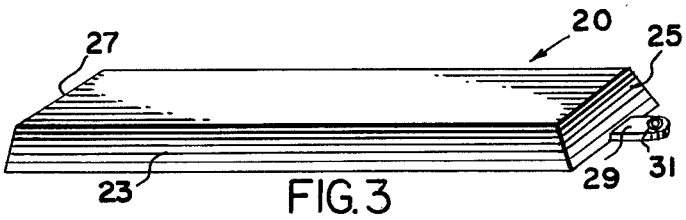
FIG. 3 is a perspective view of a portion of the apparatus illustrated in FIGS. 1 and 2.

Referring now more particularly to the drawings, a football blocking sled, generally designated S, is provided for training football players in the art of blocking and tackling.

The sled S is identical to the sled disclosed in applicant's U.S. Pat. No. 3,827,690 granted Aug. 6, 1974 which is incorporated herein by reference as though fully set forth herein. Generally, the sled S includes a ground engageable runner 12 mounting an upstanding blocking dummy support post 13. An impactable blocking dummy generally designated D, is mounted on the vertically disposed post 13 via a transversely extending post 14 telescopically received in a sleeve 16 mounted atop the post 13.

The apparatus disclosed heretofore is fully described in the aforementioned patent and will not be described in detail herein.

As described in the aforementioned patent, a football player will charge the blocking dummy D with either a face block or a shoulder block to forwardly move the dummy D in the direction of the arrow *a*. If a player impacts the dummy pad D with sufficient force, the entire sled S will forwardly move in the direction of the arrow *a*. The player continues to charge forwardly to move the dummy pad D and sled S forwardly to simulate moving an opposing player away from the play. It is important that a football player maintain a wide stance while he engages the dummy D throughout the entire blocking exercise.

To train the player in maintaining a wide base stance throughout a blocking exercise, stance training apparatus, generally designated 18, is provided and includes a ground supported, elongate stance training block generally designated 20, comprising rugged urethane foam of the self-skinning type which has an open cell inner core structure 22 and a micro-cellular structure 24 near the surface which presents a durable skin.

The block 20, which is generally trapezoidal in cross-section, has upwardly converging lateral sides 23 as well as upwardly converging front and rear ends 25 and 27 respectively. The block 20 is of such width that if a player straddles the stance training block 20 and maintains his feet on laterally opposite sides 23 of the block 20 his stance will have the proper minimum spread.

A nylon cloth 26, which extends the full length of the block 20, is bonded to the foam block 22 adjacent the lower surface thereof. When the stance training block 20 is manufactured, the nylon cloth 26 is placed at the bottom of a mold and the foam which is initially in a liquid state is injected into the mold and extruded upwardly through the nylon cloth 26. As the foam cures, it bonds to the cloth 26. As is illustrated in the drawing the forward end 29 of the cloth 26 projects forwardly beyond the forward end 25 of the block 20. A brass eyelet 31 is provided in the forward end of the nylon cloth 26 for receiving a hook 28 which is fixed to one end of an elastic or resilient tether cord 30 having a hook 32 at the opposite end connected to an eyelet 34 fixed to the front of the runner 12.

The self skinning foam comprising the block 20 is flexible, longlasting, will not splinter, tear or peel, but yet is soft enough to prevent turned ankles if a player inadvertently steps on the stance training block 20.

OPERATION

In operation, a football player assumes a charging stance in front of the sled S with his feet straddling the stance training block 20. As the football player charges forwardly and engages the blocking dummy D with his shoulders or face, he will propel the dummy pad D and the sled S forwardly in the direction of the arrow *a*. The elastic tether or cord 30 will forwardly draw the training block 20 with the sled S. To properly complete the blocking drill the player must maintain his feet on opposite sides of the block 20 throughout the entire forward movement of the sled. If the player inadvertently steps on the block 20 while the block is being executed, the elastic cord 30 will deform or stretch so that the sled can continue to move forwardly and the blocking exercise is not interrupted and the sled S can continue to move forwardly. When theplayer subsequently steps off the block 20, the elastic cord 30 will return the training block 20 forwardly toward the sled S so as to maintain the block 20 positioned between the players feet.

ALTERNATE EMBODIMENT

Figure 5:
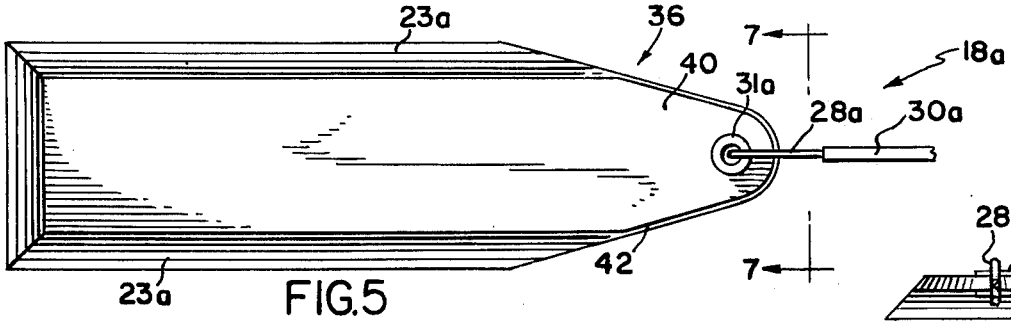
FIG. 5 is a top plan view of a slightly modified construction of the stance training apparatus.
Figure 7:
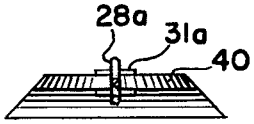
FIG. 7 is an end elevational view, taken along the line 7—7 of FIG. 5.
Figure 6:
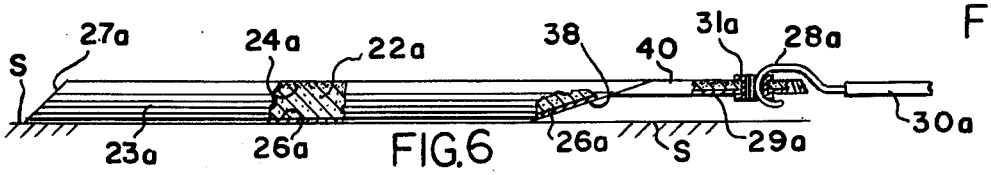
FIG. 6 is a partly sectional, side elevational view of the construction illustrated in FIG. 5.

The stance training apparatus 18*a* in FIGS. 5 – 7 is similar in many respects to the stance training apparatus 18 illustrated in FIGS. 1 – 4 and generally similar parts will be identified with generally similar numerals followed by the letter *a* subscript. In the stance training apparatus 18*a* illustrated in FIGS. 1–4, the stance training block 20 is generally symmetrical.

In the stance training apparatus 18*a*, the forward end 36 of the stance training block 20*a* is upwardly, forwardly inclined as illustrated at 38 so that the block 20*a* will more easily negotiate irregular terrain. The front end 40 of the block 20*a* to is of substantially reduced vertical thickness and extends forwardly of the inclined portion 38 and in spaced relation with the surface being traversed. The lateral sides 42 of the front end 40 also forwardly converge as is best illustrated in FIG. 5. A grommet 31*a* is provided through the forward projection 40 to receive a draft hook 28*a*.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. In a movable, ground supported, football player training sled having front and rear sides and a portion impactable by a football player to propel the sled forwardly;

stance training apparatus for teaching football players a wide base stance comprising:

a stance training object disposable on the ground between the legs of a football player; and yieldable coupling means for coupling said object to said sled in a predetermined position rearwardly adjacent said sled for movement with said sled when said portion is impacted but permitting said sled to move forwardly relative to said yieldable means to a position spaced from said object if a player inadvertently steps on said object;

said yieldable means being of such length that a players feet will normally straddle said object when the player is in position to contact said portion with his shoulders.

2. The apparatus as set forth in claim 1 wherein said yieldable means comprises resilient means for returning said stance training object forwardly relative to said sled to said adjacent position when said player steps off said object; said object being of such length that a players feet will normally straddle said object when said object is in said adjacent position and said player is in position to contact said impactable portion with his shoulder.

3. In combination with a movable football training sled having a portion which when sufficiently impacted by a football player will move the sled forwardly;

stance training apparatus means for training a football player to maintain a minimum predetermined leg spacing as the player charges the sled comprising:

stance spreading means disposable between a players legs and having a width at least equal to said predetermined spacing; and lost motion connection means connecting said stance spreading means to said sled for forward movement therewith in predetermined relative positions but permitting said sled to move forwardly relative to said stance spreading means such that said stance spreading means and said sled are in relatively spaced positions if the player inadvertently steps on said stance spreading means as he impacts said impactable portion.

4. The combination as set forth in claim 3 wherein said stance spreading means comprises an elongate object having a length substantially greater than the width thereof such that a players feet will be disposed on either lateral side of said object when said sled and said stance spreading means are in either of said predetermined positions and said spaced position.

5. The apparatus as set forth in claim 4 wherein said object comprises urethane foam.

6. The apparatus as set forth in claim 5 wherein said last motion means comprises an elastic cord.

7. The apparatus as set forth in claim 3 wherein said stance spreading means has upwardly converging lateral sides.

8. The apparatus as set forth in claim 7 wherein said stance spreading means has a trapezoidal cross-section.

9. Stance training apparatus for a football blocking sled; said blocking sled having forward and rearward sides and mounting a chargeable member which is forwardly movable when charged by a football player, said stance training apparatus comprising:

a stance spreading object disposable rearwardly of said sled between the legs of a football player charging said chargeable member; and elastic coupling means for coupling said object to said chargeable member to forwardly draw said object as said chargeable member moves forwardly but permitting said chargeable member to move forwardly relative to said object if a player inadvertently steps on said object, said coupling means being operative to return said object toward said sled when a player steps off said object;

said elastic coupling means being of such length that the feet of a player, in position to contact said chargeable member with his shoulder, will normally straddle said object;

said object comprising a foam block having forward and rearward ends and opposed lateral sides, at least the rear portion of said lateral sides being upwardly converging, and a layer of reinforcing material bonded to said block along the length thereof, said layer having forward and rearward ends, said elastic means being connected to the forward end of said layer of reinforcing material.

10. The apparatus as set forth in claim 9 wherein the rear portion of said block is trapezoidal in cross-section and has an underside for bearing against the surface to be traversed, the forward portion of said block including a forwardly upwardly inclined underside, said forward portion terminating in a reduced thickness section which is in vertically spaced relation with the underside of said rear portion.

11. Stance training apparatus for a football blocking sled; said blocking sled having forward and rearward sides and mounting a chargeable member which is forwardly movable when charged by a football player, said stance training apparatus comprising:

a stance spreading object disposable rearwardly of said sled between the legs of a football player charging said chargeable member; and elastic coupling means for coupling said object to said chargeable member to forwardly draw said object as said chargeable member moves forwardly but permitting said chargeable member to move forwardly relative to said object if a player inadvertently steps on said object, said coupling means being operative to return said object toward said sled when a player steps off said object;

said elastic coupling means being of such length that the feet of a player, in position to contact said chargeable member with his shoulder, will normally straddle said object;

said object comprising a block having forward and rearward ends and opposed lateral sides, at least the rear portion of said lateral sides being upwardly converging;

a layer of reinforcing material, having forward and rearward ends, extending along the length of the underside of said object;

said elastic means being connected to the forward end of said reinforcing material.

12. The apparatus as set forth in claim 11 wherein said block comprises foam having an open cell core and a microcellular skin which inhibits tearing if a player inadvertently steps on the block; said foam being yieldable to inhibit turned ankles if a player inadvertently steps on the object.

* * * * *